US009441445B1

(12) United States Patent
Pruitt et al.

(10) Patent No.: US 9,441,445 B1
(45) Date of Patent: Sep. 13, 2016

(54) DUAL RUBBER CARTRIDGE

(71) Applicants: Grant Pruitt, Fort Smith, AR (US); Cris Braun, Van Buren, AR (US)

(72) Inventors: Grant Pruitt, Fort Smith, AR (US); Cris Braun, Van Buren, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 305 days.

(21) Appl. No.: 14/042,386

(22) Filed: Sep. 30, 2013

Related U.S. Application Data

(63) Continuation-in-part of application No. 12/806,424, filed on Aug. 12, 2010, now Pat. No. 8,573,293, which is a continuation-in-part of application No. 12/072,929, filed on Feb. 29, 2008, now Pat. No. 7,798,210.

(51) Int. Cl.
*E21B 33/08* (2006.01)
*E21B 33/02* (2006.01)

(52) U.S. Cl.
CPC ..... *E21B 33/085* (2013.01); *E21B 33/02* (2013.01)

(58) Field of Classification Search
CPC ..... E21B 33/06; E21B 33/08; E21B 33/085
USPC ..... 166/84.3, 84.1; 277/326, 343
See application file for complete search history.

(56) References Cited

U.S. PATENT DOCUMENTS

| | | | | |
|---|---|---|---|---|
| 3,387,851 | A * | 6/1968 | Cugini | E21B 33/085 277/318 |
| 3,965,987 | A * | 6/1976 | Biffle | E21B 33/085 166/379 |
| 5,213,158 | A * | 5/1993 | Bailey | E21B 33/085 166/84.3 |
| 5,647,444 | A * | 7/1997 | Williams | E21B 33/085 166/84.1 |
| 7,798,210 | B1 * | 9/2010 | Pruitt | E21B 33/085 166/84.1 |
| 7,926,593 | B2 * | 4/2011 | Bailey | E21B 21/08 166/338 |
| 8,573,293 | B1 * | 11/2013 | Pruitt | E21B 33/085 166/84.1 |
| 2003/0106712 | A1 * | 6/2003 | Bourgoyne | E21B 23/006 175/5 |

* cited by examiner

*Primary Examiner* — Kenneth L Thompson
(74) *Attorney, Agent, or Firm* — Schrantz Law Firm, PLLC; Stephen D. Schrantz

(57) ABSTRACT

A housing of a dual rubber cartridge attaches at least one rubber to an inner barrel for rotation with the inner barrel. A first rubber and a second rubber may attach to the housing for quick installation of the rubbers. The user removes the housing to remove and replace the two rubbers. The user may then replace the original housing with a second housing on which new rubbers are installed. The housing enables the user to quickly replace the rubbers to reduce down time of the drilling operation.

18 Claims, 9 Drawing Sheets

DUAL RUBBER CARTRIDGE

CROSS-REFERENCE TO RELATED APPLICATIONS

This application claims priority to and is a continuation in part of U.S. patent application Ser. No. 12/806,424 filed on Aug. 12, 2010 entitled Dual Rubber Cartridge which issued as U.S. Pat. No. 8,573,293 on Nov. 5, 2013 which is a continuation in part of U.S. patent application Ser. No. 12/072,929 filed on Feb. 29, 2008 entitled Dual Rubber Cartridge which issued as U.S. Pat. No. 7,798,210 on Sep. 21, 2010.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

In well drilling, with a rotary drilling rig, the drill bit and drilling pipe receive rotary motion from power equipment located on the surface. Below the drilling floor, at the ground surface, an assembly known as a rotating head allows the circulation of various fluids used in the drilling. The present invention relates to a dual rubber cartridge for rotating heads for oil and gas wells and more particularly, to an improved rotating head that enables the ease of use for the end user and also a more efficient method of assembly and disassembly to decrease down time caused by assembling or disassembling the rotating head and to decrease manufacturing costs. A conventional drilling string is inserted or "stabbed" through the rotating head assembly, including the one or two rubbers rotatably mounted in the rotating head assembly, to seal the drilling string.

In well drilling, with a rotary drilling rig, the drill bit and drilling pipe receive rotary motion from power equipment located on the surface. Below the drilling floor, at the ground surface, there is usually an assembly known as a rotating head that allows the circulation of various fluids used in the drilling. Early drilling heads employed a single rubber to divert the flow of drilling fluid away from the rig floor. The rubber was fixedly mounted within the drilling head and the drill string rotated and moved longitudinally through the rubber as the rubber sealed against the string. The action of the drill string caused considerable wear on the rubber requiring frequent replacement. To reduce the abrasive wear, the rubber was rotated with the drill string to maintain sealing contact. However, a drill string typically includes various diameter sections. For example, the drill collars joining sections of drill string have a greater diameter than the drill pipe itself. Thus, the rubber was sized to maintain sealing contact with the drill pipe or the smallest diameter component which traveled through the drilling head. Because of the different diameters of the drill string, the rubber needed to be rigid enough to withstand the pressures of the drilling fluid yet resilient enough to maintain a seal on the drill collars as the drill collars passed through the drilling head and thereafter return to the original configuration to seal against the smaller diameter drill pipe. The operating cycle of the rubber was directly proportional to the number of drill collars which passed through the single rubber since the rubber would not return to its original sealing diameter.

Present day drilling operations are extremely expensive, and an effort to increase the overall efficiency of the drilling operation while minimizing expense requires the essentially continuous operation of the drilling rig. Thus, it is imperative that downtime be minimized.

In this regard, there is a need for improved sealing of the rotating head with the rubbers to maximize the useful life of the bearings. Seals for such bearings must effectively preclude the intrusion of well fluids or debris while at the same time ensuring retention of the bearing lubricant.

Primary features of the rotating head assembly of the present invention includes a dual rubber cartridge that rotatably attaches two rubbers to the drilling head such that the two rubbers rotate with the drill pipe to eliminate excess wear on the two rubbers. Further, the dual rubber cartridge of the present invention simplifies the process of removing and replacing the rubbers. The dual rubber cartridge of the present invention provides simple removal such that a user can easily replace the rubbers of the dual rubber cartridge. Further, the present invention seals the rotating head to prevent debris from entering the rotating head and prevents components from interfering with the drilling operation.

2. Description of the Known Art

Among the patents which relate to rotating head assemblies are the following:

U.S. Pat. No. 4,511,193 (the '193 patent) issued to Geczy on Apr. 16, 1985 teaches a combined radial and thrust bearing assembly for a down-hole drilling assembly to journal a shaft, mounting the drill bit, in a housing. The bearing assembly is used between a down-hole fluid powered motor and a drill bit for drilling oil wells, for example. The bearing assembly includes cooperative pairs of upper and lower inner races located on the shaft for mutual rotation. Each of the inner races includes a pair of interchangeable toroidal tracks. Cooperative pairs of upper and lower outer races are fixed against rotation in the housing. Each outer race has a pair of interchangeable toroidal tracks to selectively cooperate with the tracks of the inner races to define a toroidal channel to receive a number of bearing balls. Spring means are disposed between the upper and lower pairs of outer races and the housing and between the upper and lower pairs of outer races to provide a compliant coupling for the even distribution of radial and upwardly and downwardly directed thrust loads between the races and balls and eventual transfer to the housing. Drilling fluid is circulated through the bearing assembly for cooling and lubrication.

U.S. Pat. No. 5,213,158 ("the '158 patent") issued to Bailey, et al. on May 25, 1993 teaches a drilling head with dual rotating stripper rubbers designed for high pressure drilling operations ensuring sealing under the extreme conditions of high flow or high pressure wells such as horizontal drilling. The dual stripper rubbers taught by the '158 patent seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

U.S. Pat. No. 5,647,444 issued to Williams on Jul. 15, 1997 discloses a rotating blowout preventor having at least two rotating stripper rubber seals which provide a continuous seal about a drilling string having drilling string components of varying diameter. A stationary bowl is designed to support a blowout preventor bearing assembly and receives a swivel ball that cooperates with the bowl to self-align the blowout preventor bearing assembly and the swivel ball with respect to the fixed bowl. Chilled water is circulated through the seal boxes of the blowout preventor bearing assembly and liquid such as water is pumped into the bearing assembly annulus between the stripper rubbers to offset well pressure on the stripper rubbers.

SUMMARY OF THE INVENTION

The drilling head of the present invention includes a housing, the dual rubber cartridge, which houses dual rotating stripper rubbers rotatably attached to an inner barrel of a rotating head assembly. As a result, the rubbers will also rotate with the rotating head assembly thus maintaining the seal with the drill string to divert the drilling fluid from the well to the outlet flange.

The dual rotating rubbers have diameters to simultaneously seal against the drill string, specifically the smaller diameter drill pipe. The dual rubbers maintain a constant seal of the drill pipe to prevent debris and other contaminants from entering the rotating head assembly. The present invention utilizes a dual rubber cartridge that securely attaches a first rubber and a second rubber to the inner barrel for rotation with the inner barrel.

The present invention reduces the downtime of the drilling rig by reducing time expended replacing the rubbers. Known rotating heads require a user to individually remove each rubber after halting operation of the drilling rig. Thus, known rotating heads increased downtime of the drilling and reduced the operating time of the drilling rig to increase expenses of the drilling operation.

The present invention allows a user to have prepared a bottom pot with adequate rubbers prior to halting operation of the drilling rig. Therefore, drilling operation continues while attaching the rubbers to the bottom pot. To replace both the first and second rubbers in a single step, a user stops the drilling rig and replaces the bottom pot with the changed first and second rubbers. Unlike known systems, the present invention does not require drilling operation to cease while each individual rubber is replaced. By installing the bottom pot with the replaced first and second rubbers, the user eliminates the steps required to be completed when the drilling operation is ceased. Thus, the present invention increases the operation of the drilling rig.

The quick attachment of the present invention also allows attachment of the bottom pot to the inner barrel without the use of threaded fasteners. By utilizing a quick attachment system, the present invention reduces the amount of time uninstalling a bottom pot and reinstalling the bottom pot. Therefore, the quick attachment system of the present invention reduces downtime of the drilling rig.

The present invention also eliminates possible damage from fasteners that loosen during the drilling operation. The known art allowed exposed fasteners that loosened during operation of the drilling rig. The loosened fasteners could then drop into the drilling hole. Because the drilling rig would continue to operate with the fastener in the drilling hole, the drilling bit wears at a faster rate because of the grinding of the fastener. The present invention partially encloses the fasteners to prevent fasteners from damaging the drilling bit. By partially enclosing the fasteners, the present invention secures the fasteners even if the fasteners should loosen during operation of the drilling rig. Components of the present invention abut the fasteners such that the fasteners will remain in the fasteners' respective apertures should the fasteners loosen.

Other objects, features, and advantages of the invention will be apparent from the following detailed description taken in connection with the accompanying drawings.

It is an object of the present invention to provide an improved rotating head that enables ease of use for the end user.

Another object of the present invention is to allow more efficient assembly and disassembly of the rotating head assembly.

Another object of the present invention is to increase efficiency of the assembly and disassembly of the rotating head assembly to decrease the amount of down time due to necessary repairs of the rotating head assembly.

Another object of the present invention is to increase the life of bearings, seals, and other internal components by preventing debris from entering the bearings, seals, and other internal components.

Another object of the present invention is to allow for the trouble free operation of the rotating head assembly for the rig personnel.

Another object of the present invention is to create a safer work environment for rig personnel.

Another object of the present invention is to simplify the method of assembly of the rotating head assembly.

Another object of the present invention is to allow a quick change rubber system that will save valuable time on the rig, thus eliminating time in which the rig is inoperable.

Another object of the present invention is to eliminate the problems arising from the use of threaded parts.

Another object of the present invention is to prevent unnecessary wear and damage to the drill string.

In addition to the features and advantages of the rotating head assembly according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
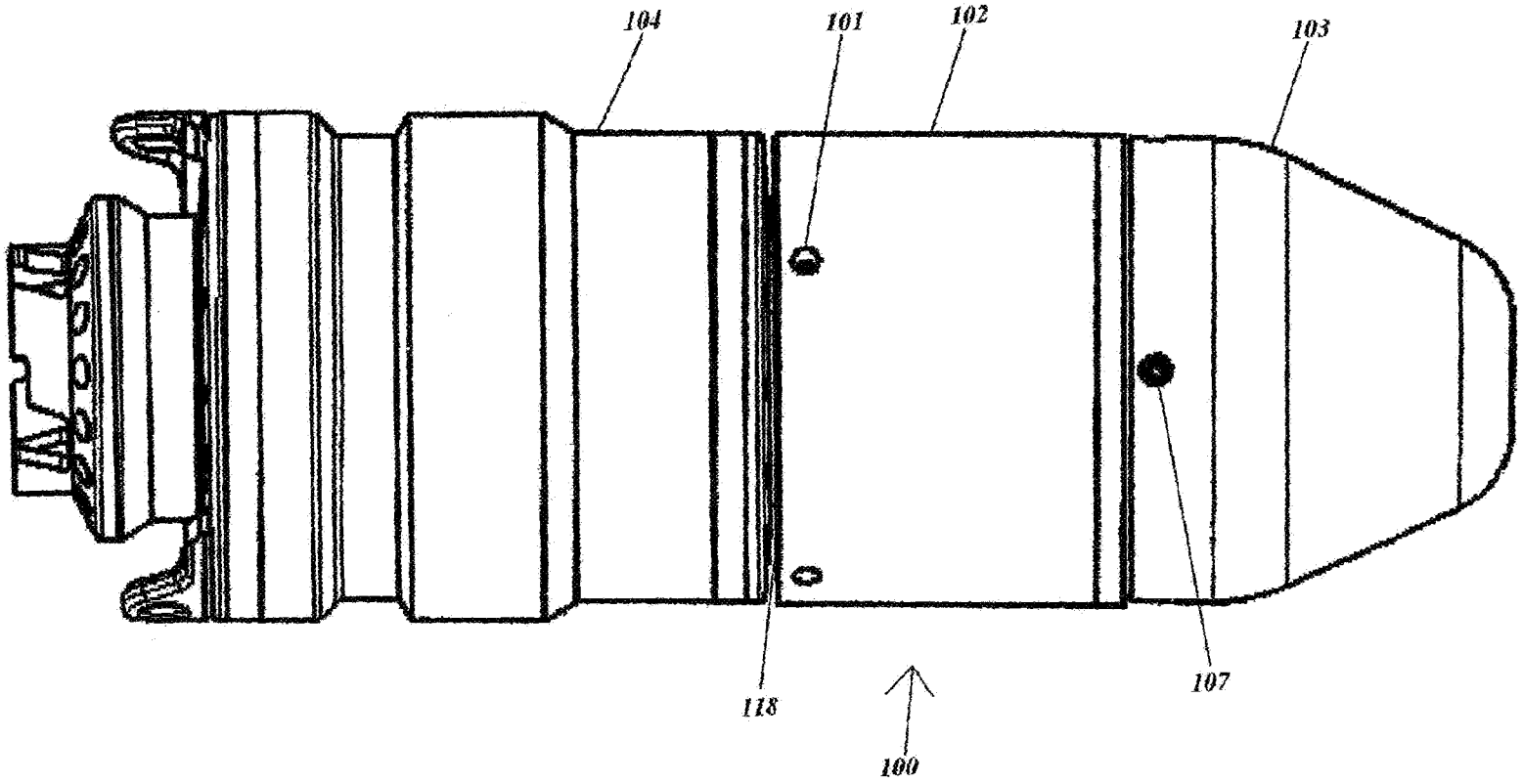
FIG. 1 is a front elevational view showing one embodiment of the present invention.

Referring to FIG. 1, the rotating head assembly of the present invention is generally illustrated by reference numeral 100. The rotating head assembly 100 is characterized by a housing 99, a bottom pot 102, an outer barrel 104, and a second rubber 103. Bottom pot 102 is releasably connected to inner barrel 118 at fastener 101. As shown in FIG. 1, bottom pot 102 is attached to second rubber 103 by the locking pin 107 of the second rubber 103. Second rubber 103 attaches to stripper pot plate 192. Locking pin 107 attaches second rubber 103 to stripper pot plate 192. Stripper pot plate 192 is securedly attached to bottom pot 102 by use of known fasteners such as threaded fasteners, including but not limited to bolts.

Figure 2:
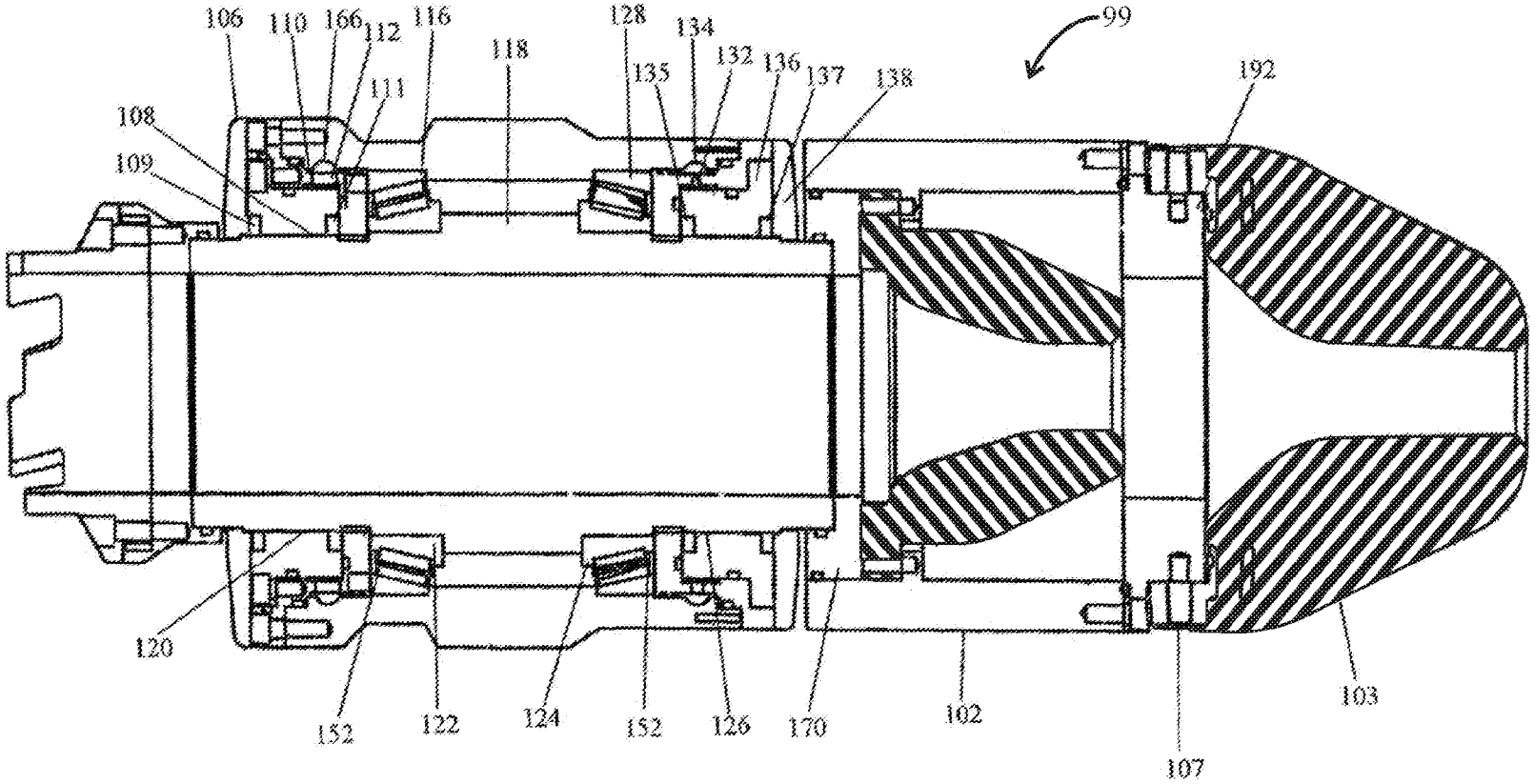
FIG. 2 is an internal view thereof.

FIG. 2 shows a cutaway view of the present invention and the rotatable attachment of inner barrel 118 to outer barrel 104. As seen in FIG. 2, plates 106, 138 are releasably attached to liners 108, 136 by a fastener including but not limited to threaded fasteners or other known fasteners. Plates 106, 138 prevent debris and other contaminants from entering the rotating head assembly. The secured connection between plates 106, 138, liners 108, 136, and outer barrel 104 prevents debris from entering the bearing elements thus reducing unnecessary damage and downtime of the rotating head assembly.

As shown in FIG. 2, liners 108 and 136 are inserted into box assemblies 110, 134 to seal the inner barrel 118 to protect the bearing elements 116, 128 from the outside environment. Such seals maintain pressure within the drilling head. In addition, such seals prevent well bore pressure from entering the drilling head. Referring to FIG. 2, liners 108, 136 are inserted into box assemblies 110, 134 to bias locking elements 112, 132 to secure box assemblies 110, 134 to outer barrel 104 without the use of other known fasteners. By eliminating other types of fasteners, the locking elements 112, 132 reduce the time needed to assemble and disassemble the rotating head assembly. The locking elements 112, 132 of the present invention remove steps required for assembling known rotating heads. The insertion of liners 108, 136 into box assemblies 110, 134 biases locking elements 112, 132 to the locked position. Therefore, attaching inner barrel 118 to outer barrel 104 simply requires insertion of liners 108, 136.

The present invention also provides a secondary connection for attaching box assemblies 110, 134 to outer barrel 104. As a secondary attachment, the present invention provides fastening apertures of both box assemblies 110, 134 and outer barrel 104 for securing box assemblies 110, 134 to outer barrel 104 by threaded fasteners or other known fasteners. With the back-up secondary attachment system, the present invention also provides a more secure connection between outer barrel 104 and inner barrel 118.

As shown in FIG. 2, box assemblies 110, 134 create a bearing assembly by releasably securing plate 106, liner 108, box 110, bearing element 116, plate 138, liner 136, box 132, and bearing element 128 to outer barrel 104 such that inner barrel 118 is mounted for rotation with respect to outer barrel 104. When liners 108, 136 are inserted into box assemblies 110, 134, locking elements 112, 132 engage a locking groove 166 found inside outer barrel 104. The locking elements 112, 132 securely connect box assemblies 110, 134 to outer barrel 104 without the use of bolts or other known fasteners. The box assemblies 110, 134 of the present invention allow a simplified method of assembling and disassembling the rotating head assembly 100. As a secondary connection, in one embodiment of the present invention, fasteners also secure box assemblies 110, 134 to outer barrel 104.

Top plate 106 is securedly attached to liner 108 and box assembly 110. Top plate 106 covers the high pressure assembly to prevent debris and other contaminants from entering the rotating head assembly.

The present invention also reduces the amount of debris and other contaminants that enter the rotating head assembly. The contact between seals 109, 111, 135, 137 and wear surfaces 120, 126 prevent debris and other contaminants from entering bearing elements 114, 128. Furthermore, the present invention utilizes liners 108, 136 with a seal cavity that adjusts the placement of the seals 109, 111, 135, 137 on the wear surfaces 120, 126. The seals 109, 111, 135, 137 contact wear surfaces 120, 126 to seal and reduce damage to bearing elements 116, 128. Inner barrel 118 rotates in relation to both liners 108, 136 and the seals 109, 111, 135, 137 located within the seal cavities of liners 108, 136. Therefore, as inner barrel 118 rotates in relation to seals 109, 111, 135, 137, wear surfaces 120, 126 erode at the contact point of the seals 109, 111, 135, 137 and wear surfaces 120, 126 during drilling operations.

Over a period of use, wear surfaces 120, 126 deteriorate such that the bearing elements 114, 128 are not properly enclosed. To prevent damage to bearing elements 114, 128, seal cavities of liners 108, 136 are re-machined to adjust the location of the seals 109, 111, 135, 137 to an unused portion of wear surfaces 120, 126. Because liners 108, 136 do not vertically move in relation to inner barrel 118 and wear surfaces 120, 126, the seals 109, 111, 135, 137 erode a concentric ring around wear surfaces 120, 126. After wear surfaces 120, 126 have eroded such that the seals 109, 111, 135, 137 no longer properly protect bearing elements 116, 128, the present invention allows re-machining of the seal cavities of liners 108, 136 to vertically displace the seals 109, 111, 135, 137. The vertically displaced seals 109, 111, 135, 137 now contact an unused area of wear surfaces 120, 126. Because the wear surfaces 120, 126 erode in a concentric manner, the seals 109, 111, 135, 137 will not contact the deteriorated areas of wear surfaces 120, 126 during rotation of inner barrel 118 in relation to outer barrel 104. By adjusting the location of the seals 109, 111, 135, 137 to an unused portion of wear surfaces 120, 126, seals 109, 111, 135, 137 and wear surfaces 120, 126 properly enclose bearing elements 114, 128. Thus, the adjusted seals 109, 111, 135, 137 prevent unnecessary damage to the rotating head assembly. The newly relocated seals 109, 111, 135, 137 will now wear an unused area of the same integrated wear surfaces 120, 126 of the inner barrel 118 such that the present invention utilizes the entire wear surfaces 120, 126 of the inner barrel 118.

Seals 109, 111, 135, 137 maintain pressure within the rotating head assembly and prevent well bore pressure from entering the rotating head assembly. Hydraulic fluid within the rotating head assembly maintains the pressure in the rotating head assembly. In addition, the hydraulic fluid found within the rotating head assembly lubricates the bearing elements 116, 128. Metal encased spring loaded seals 109, 111, 135, 137 are mounted on wear surfaces 120, 126 of inner barrel 118. The seals 135, 137 contacting wear surface 126 are arranged in a manner that will allow a continuous pressurized flush of the internal cavity of the bearing assembly. The continuous flushing will result in a longer life of the bearings, seals, and other internal components. The two seals 109, 111 contacting wear surface 120 are arranged in a manner that will allow circulation for constant supply of lubrication from multiple inlet ports. The lubricant circulation system is configured to enhance the cooling of the seals 109, 111, 135, 137 whereby essentially round-the-clock operation may be maintained for months at a time without seal malfunction that would require a shutdown of the drilling operation.

As shown in FIG. 2, box assemblies 110, 134 are placed adjacent to bearing elements 116, 128. Because installation of liners 108, 136 attaches box assemblies 110, 134 to outer barrel 104, the box assemblies 110, 134 are installed such that the box assemblies 110, 134 load bearing elements 116, 128. Bearing elements 116, 128 allow inner barrel 118 to rotate in relation to outer barrel 104. In one embodiment, box assemblies 110, 134 contain die springs 152 that load bearing elements 116, 128 pursuant to the manufacturer's specifications.

Die springs 152 located within spring apertures of box assemblies 110, 134 create a constant load of bearing elements 116, 128. The die springs 152 are arranged within box assemblies 110, 134 to load bearing elements 116, 128 according to the manufacturer's specifications. The constant load of bearing elements 116, 128 reduces the down time caused by unsatisfactory bearing elements. Further, the constant load of bearing elements 116, 128 reduces unnecessary damage to bearing elements 116, 128. Such a constant load of bearing elements 116, 128 reduces costs of replacing bearing elements 116, 128 and increases the operating time of the drilling rig.

Die springs 152 maintain a constant load on bearing elements 116, 128. By maintaining a constant load, the present invention can better maintain the manufacturer's recommended load on bearings 116, 128. For example, if a manufacturer's specifications requires loading the bearings with twelve (12) ninety-four (94) pound die springs, one embodiment of the present invention provides box assemblies 110, 134 loaded with twelve (12) ninety-four (94) pound die springs to maintain a constant load on bearings 116, 128 such that the present invention does not require special equipment required to measure the load exerted on the bearings. The box assemblies 110, 134 of the present invention are loaded with the number and type of die springs specified by the manufacturer of the bearings. Therefore, the number and type of die springs utilized in the present invention depends upon the manufacturer's specifications for loading the bearing elements. Further, as the internal bearing cavity wears, the die springs 152 of the present invention adjust for the wear of the internal cavity such that the load on the bearings will remain constant over use. By maintaining a constant load on the bearings, the present invention extends the life of the rotating drill head and allows for trouble free operation for rig personnel.

The bearing elements 116, 128 are machined such that the bearing elements 116, 128 are indicated directly to the wear surfaces 120, 126, which allows for the desired "zero TIR" that is crucial when managing pressure. By integrating the wear surfaces 120, 126 on the inner barrel 118, the present invention eliminates the assembly process of installing and uninstalling the wear surfaces 120, 126 via bolts, screws or any other known fasteners to attach the wear surfaces 120, 126 to the inner barrel 118.

Figure 3:
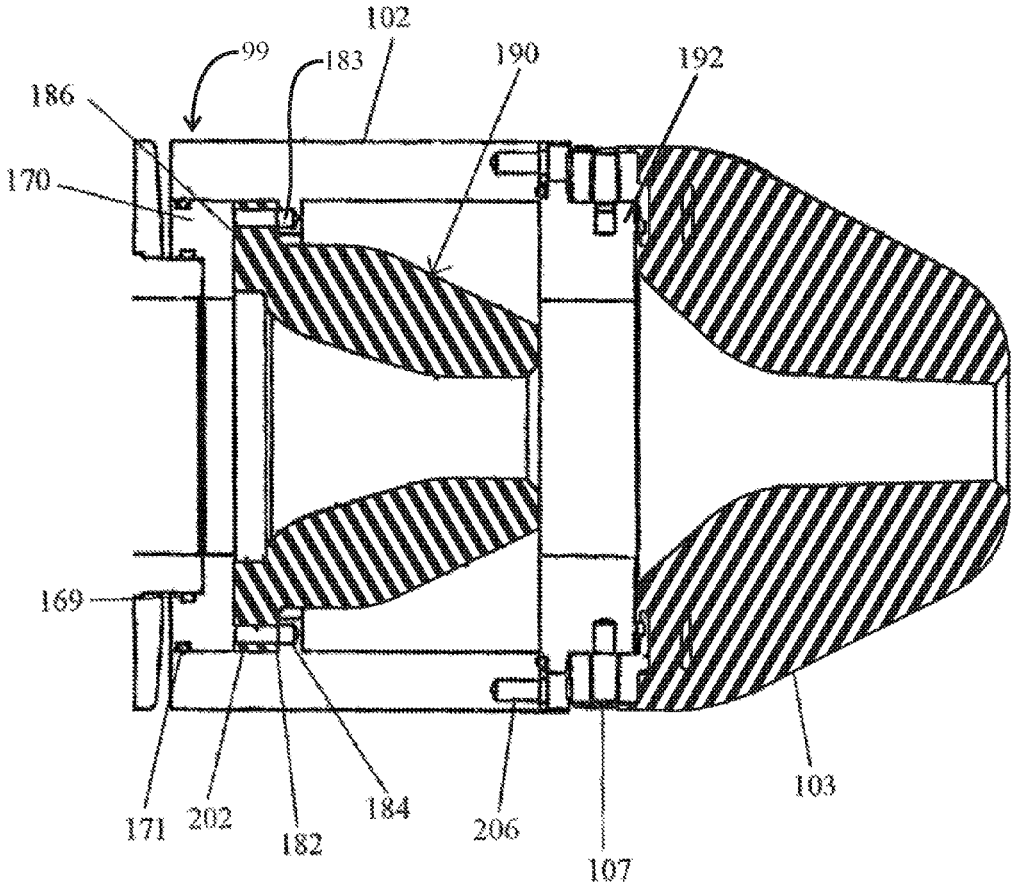
FIG. 3 is an internal view of the dual rubber cartridge of the present invention.
Figure 3A:
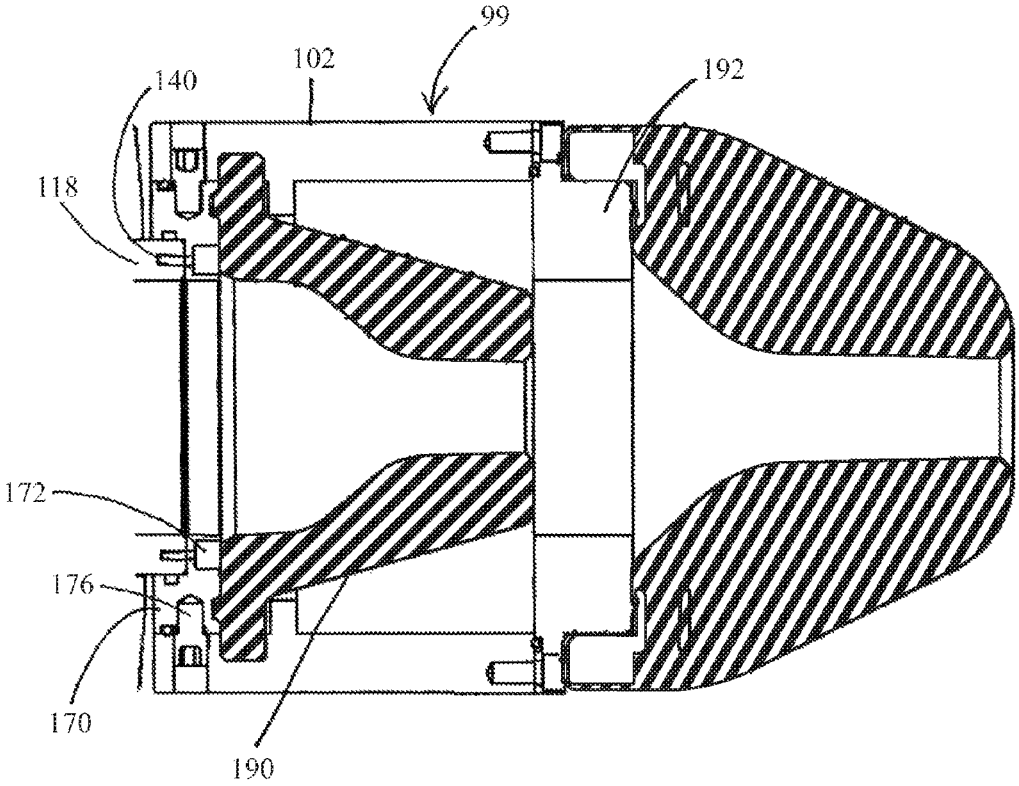
FIG. 3*a* is another internal view of the dual rubber cartridge of the present invention.

FIGS. 2 and 3 show the dual rubber cartridge and the attachment of the dual rubber cartridge to the inner barrel 118. Stripper adapter 170 securely attaches bottom pot 102 to the inner barrel 118. Adapter fastener securely attaches stripper adapter 170 to inner barrel 118. Adapter fastener can be any known fastener. Bottom pot 102 securely attaches to inner barrel 118 such that bottom pot 102 rotates with inner barrel 118. Stripper adapter 170 also fixedly attaches the first rubber 190 to inner barrel 118. First rubber 190 provides a hollow area in which a drill string is inserted. First rubber 190 is constructed of a material that is flexible enough to seal against the drill string while the drill string is inserted through first rubber 190. First rubber 190 seals the drill string to prevent debris and other contaminants from entering the rotating head assembly to reduce wear of the drill string and the rotating head assembly.

Stripper pot plate 192 securely attaches to bottom pot 102. The secure attachment of stripper pot plate 192 to bottom pot 102 rotates stripper pot plate 192 and second rubber 103 with inner barrel 118. Stripper pot plate fastener 206 securely fastens stripper pot plate 192 to bottom pot 102. Stripper pot plate 192 provides a locking groove 196 adapted to receive locking finger 107 to attach second rubber 103 to stripper pot plate 192.

Second rubber 103 rotates with inner barrel 118 and the drill string. Similar to the first rubber 190, second rubber 103 is constructed of a flexible rubber that seals the drill string to prevent debris and other contaminants from entering the rotating head assembly.

The assembly method of the present invention eliminates exposed bolts and other known fasteners. By removing exposed fasteners, the present invention encloses the fasteners to secure the fasteners within the appropriate fastening apertures. Thus, the present invention prevents fasteners from dropping into the drilling area. The present invention secures the fasteners such that fasteners will not interfere with the operation of the rotating head assembly. The fasteners of the present invention are secured such that the fasteners will not fall into the drilling area as discussed below. Thus, the fasteners will not cause deterioration of the drill string. The present invention extends the lifespan of the components of the present invention by preventing unnecessary wear of the components.

In addition, the second rubber 103 of the present invention prevents stripper pot plate fastener 206 from accidental removal.

Figure 5:
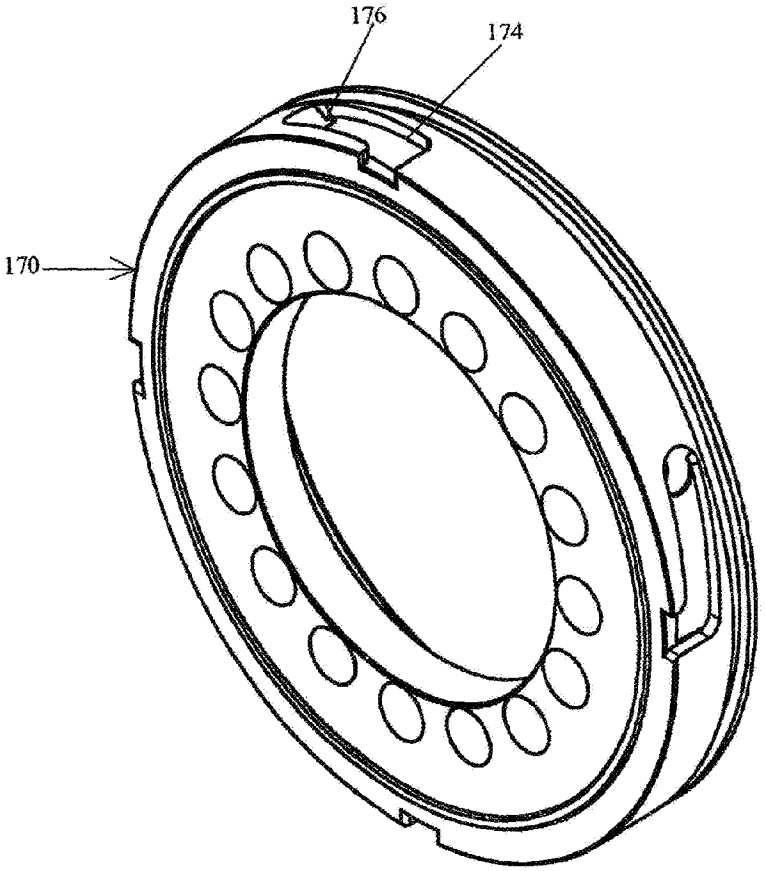
FIG. 5 is another perspective view thereof.
Figure 4:
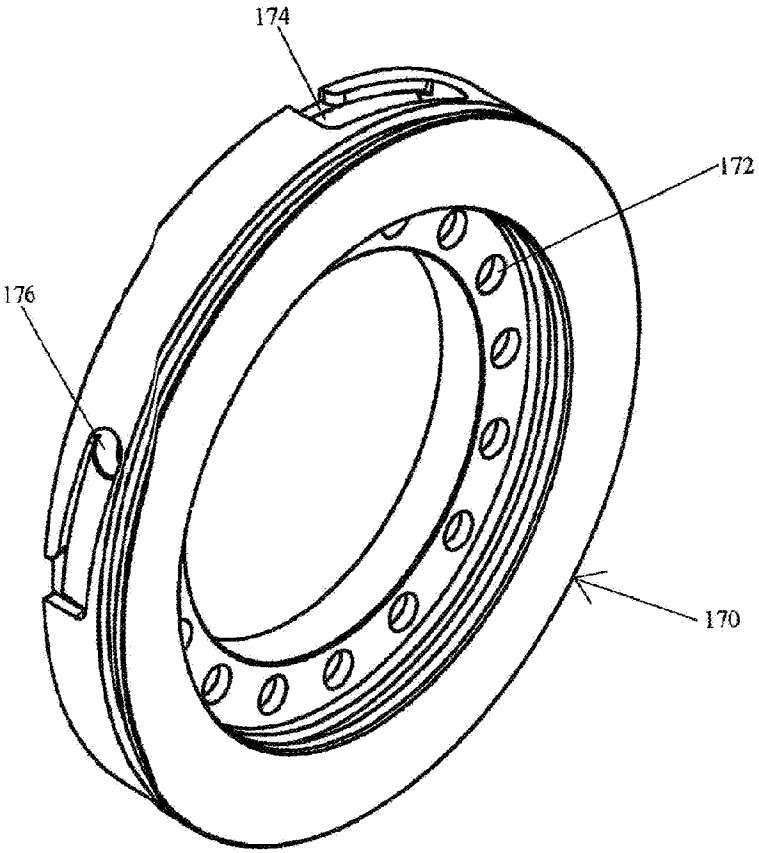
FIG. 4 is a perspective view of the stripper adapter of the present invention.
Figure 7:
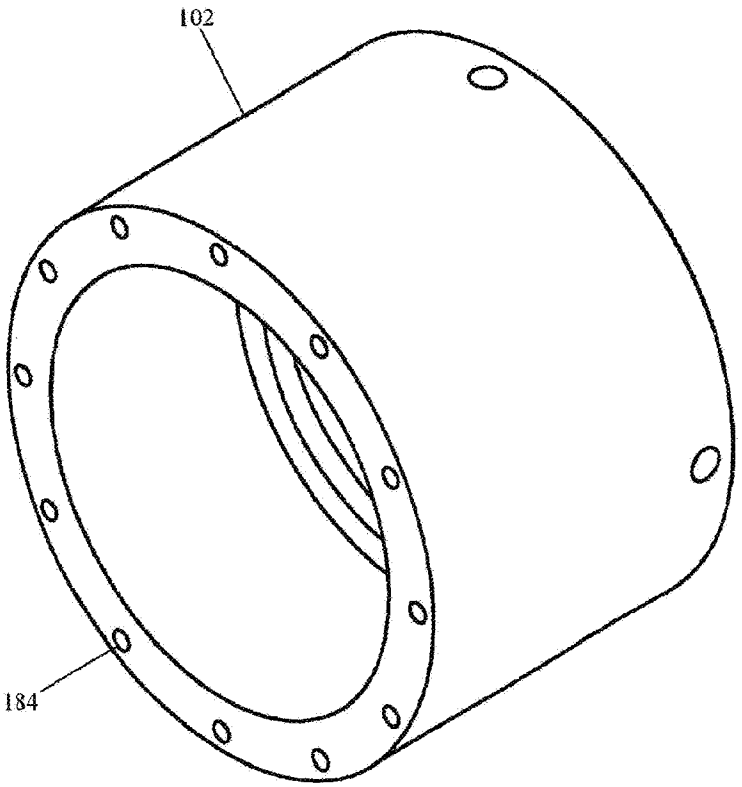
FIG. 7 is a perspective view thereof.
Figure 6:
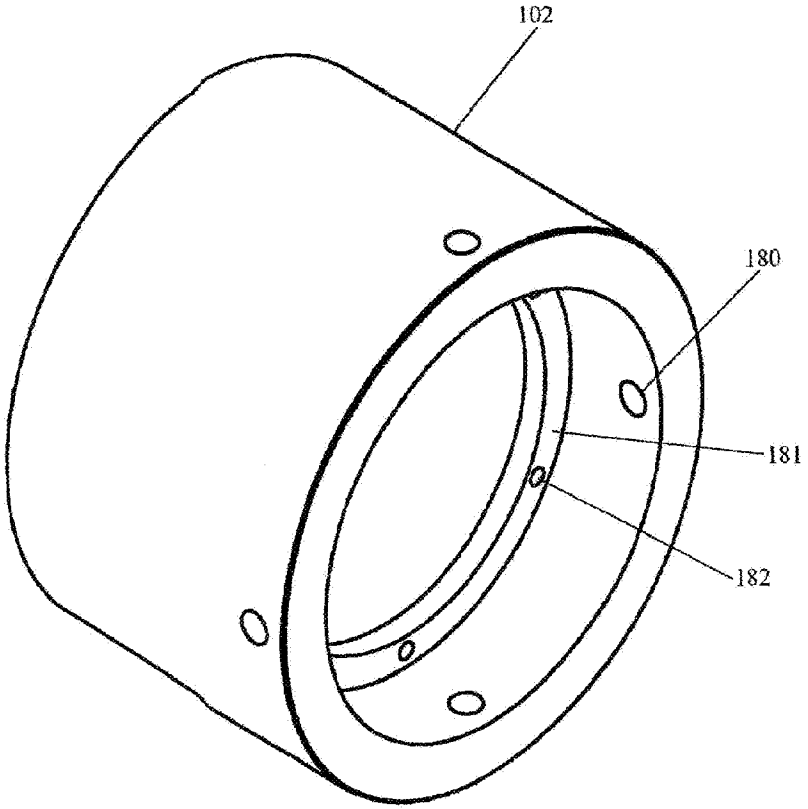
FIG. 6 is a perspective of the bottom pot of the present invention.

FIGS. 4 and 5 show a top and bottom view of the stripper adapter 170 of the present invention. The adapter fastening apertures 172 of stripper adapter 170 allow fasteners, including but not limited to known fasteners such as a bolt, to secure stripper adapter 170 to fastening apertures 140 of inner barrel 118. Fasteners inserted through the multiple adapter fastening apertures 172 securely attach stripper adapter 170 to inner barrel 118 such that stripper adapter 170 rotates with inner barrel 118 to prevent degradation of the first rubber 190 and second rubber 103.

Referring to FIG. 3, the present invention also provides O-rings 169, 171 to seal the rotating head assembly to prevent debris and other contaminants from entering the drilling head assembly. O-ring 169 seals the area between stripper adapter 170 and inner barrel 118 seals. O-ring 171 seals the area between stripper adapter 170 and bottom pot 102.

As shown in FIGS. 4 and 5, stripper adapter 170 also provides locking pin guide 174. Locking pin guide 174 serves as a method of attaching the bottom pot 102 to stripper adapter 170. Locking pin, a known fastener including but not limited to a set screw, installed in fastener aperture 180 of bottom pot 102 (as shown in FIG. 3) attaches bottom pot 102 to stripper adapter 170. To attach bottom pot 102 to stripper adapter 170, locking pin located in fastener aperture 180 of bottom pot 102 is inserted into the locking pin guide 174. Locking pin guide 174 allows bottom pot 102 to rotate such that locking pin guide 174 directs locking pin installed in fastener aperture 180 toward locking pin aperture 176. By securing locking pin installed in fastener aperture 180 in locking pin aperture 176, bottom pot 102 securely attaches to stripper adapter 170.

As shown in FIGS. 3, 6-9, bottom pot 102 provides a stripper attachment base 181 for placement of first rubber 190. The first rubber 190 located adjacent to stripper attachment base 181 such that bottom pot fastening apertures 182 align with first stripper fastening apertures 188. Base fasteners 202 fixedly attach first rubber 190 to bottom pot 102 such that first rubber 190 rotates with bottom pot 102.

Stripper pot plate fasteners 206 securely attach the stripper pot plate 192 to bottom pot 102 through bottom pot fastening apertures 184 of stripper pot base 183. Stripper pot plate fasteners 206 securely attach bottom pot 102 to stripper pot plate 192 such that stripper pot plate 192 rotates with bottom pot 102. The rotation of bottom pot 102 and stripper pot plate 192 rotates both first rubber 190 and second rubber 103 at the same rate as inner barrel 118 and the drilling string.

Figure 9:
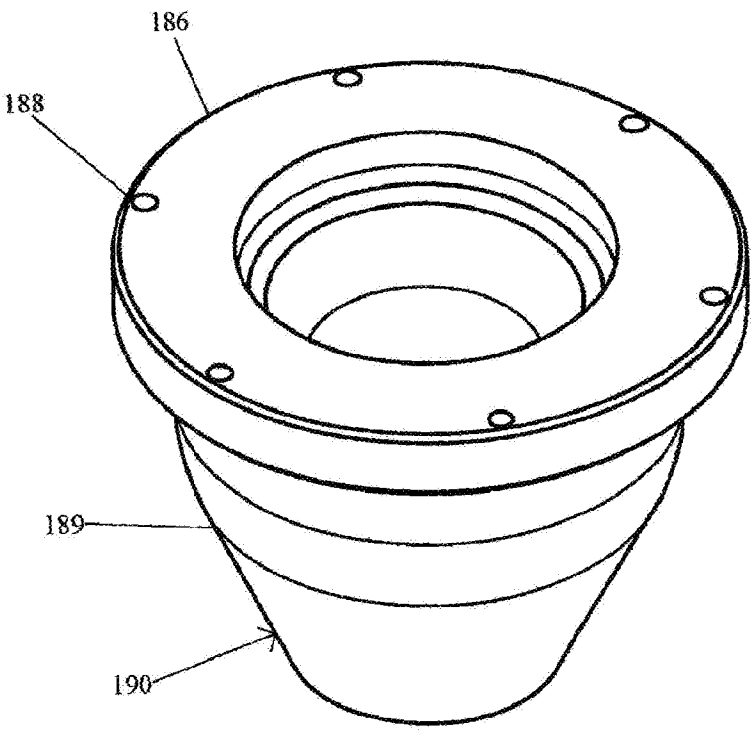
FIG. 9 is a perspective view thereof.
Figure 8:
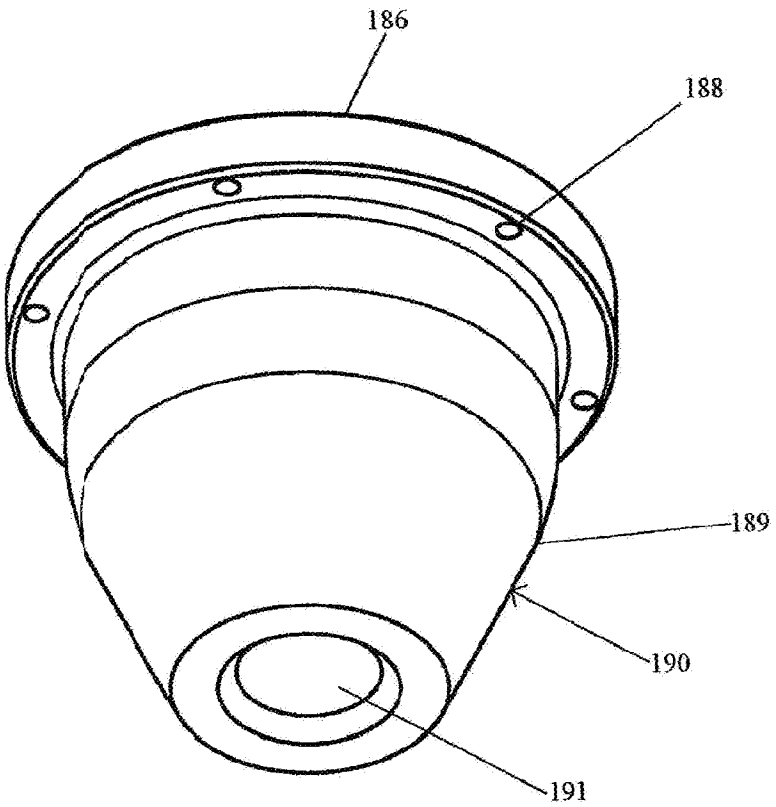
FIG. 8 is a perspective view of the first rubber of the present invention.
Figure 11:
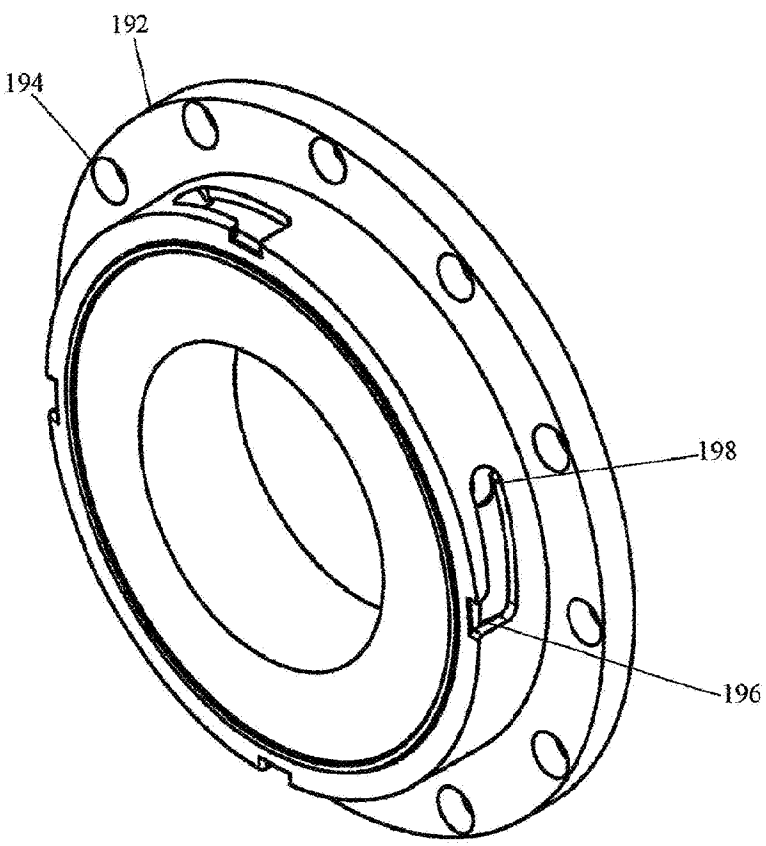
FIG. 11 is a perspective thereof.
Figure 10:
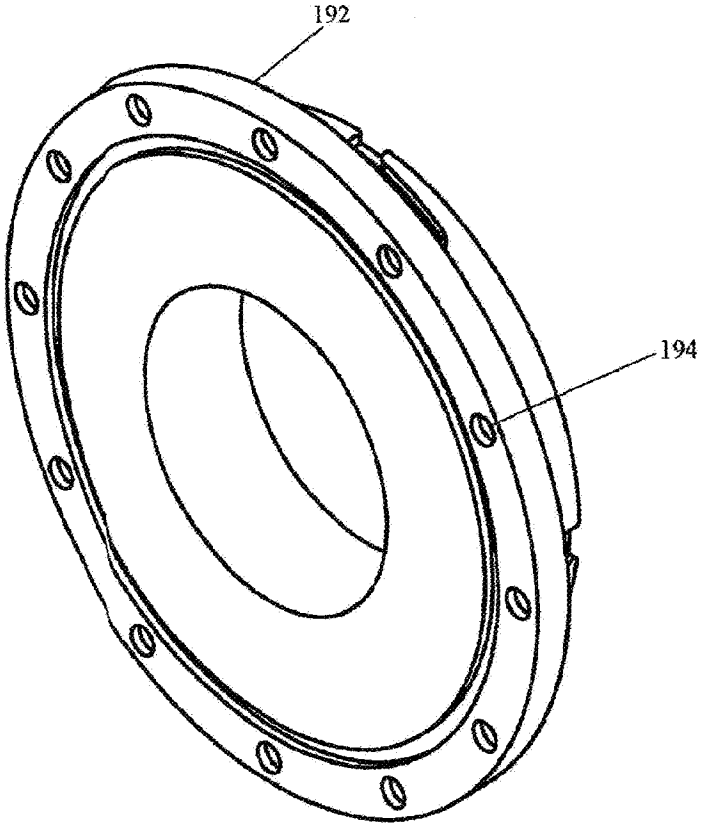
FIG. 10 is a perspective view of the stripper pot plate of the present invention.

As shown in FIGS. 8 and 9, pot plate fasteners 206 securely attach first rubber base 186 of first rubber 190 to the bottom pot 102 through first rubber fastening aperture 188. To prevent damage to the drill string, first rubber cone 189 tapers to seal first rubber 190 against a drilling string punched through the first rubber aperture 191 of first rubber 190. First rubber 190 prevents contaminants and other debris from interfering with the operation of the drilling string and the rotating head assembly.

As shown in FIGS. 3, 10-13, stripper pot plate fasteners 206 securely attach bottom pot 102 to stripper pot plate 192 through stripper pot plate fastening apertures 194. Stripper pot plate 192 secures second rubber 103 to the rotating head assembly such that second rubber 103 is fixedly attached to stripper pot plate 192. Because second rubber 103 is fixedly attached to stripper pot plate 192, second rubber 103 rotates with inner barrel 118, bottom pot 102, first rubber 190, and stripper pot plate 192. Locking pin 107 of second rubber 103 attaches second rubber 103 to stripper pot plate 192. Locking pin guide 196 of stripper pot plate 192 directs locking pin 107 towards locking pin aperture 198. Locking pin 107 inserts into locking pin aperture 198 of stripper pot plate 192. Once locking pin 107 is inserted into locking pin aperture 198, second rubber 103 is fixedly attached to stripper pot plate 192.

Figure 13:
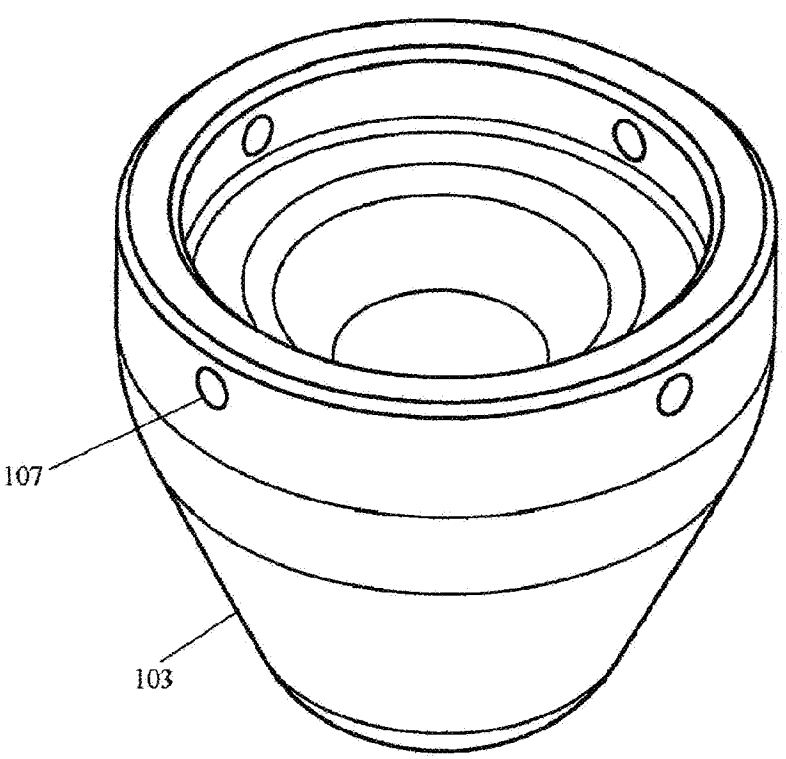
FIG. 13 is a perspective view thereof.
Figure 12:
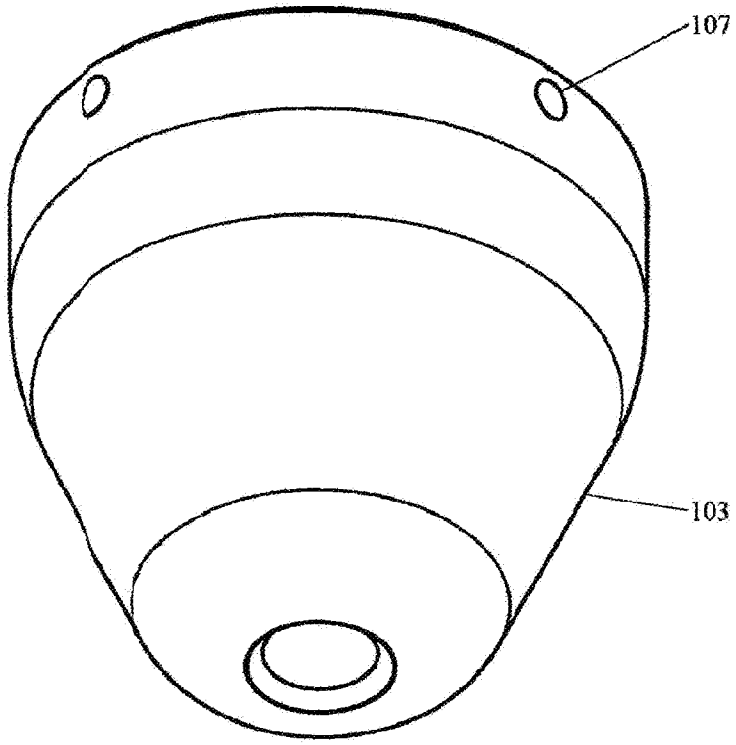
FIG. 12 is a perspective view of the second rubber of the present invention.

FIGS. 12 and 13 show the second rubber 103 of the present invention. In one embodiment of the present invention, second rubber 103 utilizes locking pin 107 to removably attach second rubber 103 to stripper pot plate 192. Locking pin 107 is placed within locking guide 196 of stripper pot plate 192. Second rubber 103 is then adjusted such that locking pin 107 is inserted into rubber locking aperture 198 to secure the second rubber 103 to the stripper adapter 170.

The present invention also provides an improved method of replacing the first and second rubbers 103, 190 of the rotating head assembly. Through normal operations, the first and second rubbers 103, 190 of the rotating head assembly deteriorate such that the first and second rubbers 103, 190 no longer properly seal the drill string. The first and second rubbers 103, 190 must be replaced such that the drill string is properly sealed to prevent debris and other contaminants from entering the rotating head assembly. The present invention allows quick replacement of the first and second rubbers 103, 190 such that drilling can continue with little downtime for normal maintenance.

The present invention allows replacement of both the first and second rubbers 103, 190 by installing a bottom pot 102 securely attached to different first and second rubbers 103, 190. To replace the bottom pot 102, a user quickly disengages locking pin installed in fastener aperture 180 to detach bottom pot 102 from stripper adapter 170. Because bottom pot 102 securely attaches both first rubber 190 and second rubber 103, first and second rubbers 103, 190 also detach from the rotating head assembly. The user can then replace the first and second rubbers 103, 190 attached to bottom pot 102 and reinstall the bottom pot 102 to the stripper adapter 170. The present invention provides the user with the option of replacing one of the first rubber 190, the second rubber 103, or both the first and second rubbers 103, 190. Bottom pot 102 must be disengaged from the rotating head assembly to allow replacement of the first rubber 190. A user can replace the second rubber 103 without removing the bottom pot 102. In order to expedite the process, the present invention allows a user to replace the bottom pot 102 attached to worn rubbers 103, 190 with a bottom pot 102 attached to replacement rubbers 103, 190. By replacing the bottom pot 102, a user increases the operation of the drilling rig by eliminating the amount of time spent replacing the first rubber 190 and second rubber 103.

The present invention reduces the downtime of the drilling rig by reducing time expended replacing the rubbers. Known rotating heads require a user to individually remove each rubber after halting operation of the drilling rig. Thus, known rotating heads increased downtime of the drilling and reduced the operating time of the drilling rig to increase expenses of the drilling operation.

The present invention allows a user to prepare a bottom pot 102 with adequate rubbers 103, 190 prior to halting operation of the drilling rig. Therefore, drilling operation continues while attaching the rubbers 103, 190 to the bottom pot 102. To replace both the first and second rubbers 103, 190 in a single step, a user stops the drilling rig and replaces the bottom pot 102 with the replacement first and second rubbers 103, 190. Unlike known systems, the present invention does not require drilling operation to cease while each individual rubber is replaced. By installing the bottom pot with the replaced first and second rubbers 103, 190, the user eliminates the steps required to be completed when the drilling operation is ceased. Thus, the present invention increases the operation of the drilling rig. The present invention reduces the downtime of the drilling rig by reducing time expended replacing the rubbers. Known rotating heads require a user to individually remove each rubber after halting operation of the drilling rig. Thus, the present invention increases operation of the drilling rig and decreases drilling expenses.

To replace the first rubber 190, a user removes base fasteners 202 from bottom pot fastening apertures 182 and first stripper fastening apertures 188. Removal of base fasteners 202 from fastening apertures 182 and first stripper fastening apertures 188 detaches the first rubber from the bottom pot 102. The user can then replace the first rubber 190 with a new first rubber 190 that will properly seal against the drilling string. The user reinstalls the first rubber 190 against the stripper attachment base 181 such that bottom pot fastening apertures 182 and first stripper fastening apertures 188 are aligned to accept a base fasteners 202 for attachment of the first rubber 190 to the bottom pot 102. The user installs the base fasteners 202 such that first rubber 190 is fixedly attached to bottom pot 102.

As shown in FIG. 3, the present invention partially encloses base fasteners 202 to prevent the base fasteners 202 from damaging the rotating head assembly should the base fasteners 202 become unsecured from bottom pot fastening aperture 184. As shown in FIG. 3, the base fasteners 202 are partially enclosed by bottom pot 102 and stripper adapter 170. The bottom pot 102 and stripper adapter 170 traps a disengaged base fastener 202 to prevent unnecessary damage of the rotating head assembly caused by dislodged base fasteners 202.

To replace the second rubber 103, the user removes second rubber 103 by disengaging locking pin 107 from locking pin aperture 198. The user rotates second rubber 103 to direct locking pin 107 through locking pin guide 196 and removes the second rubber. The user can then replace the second rubber 103 with a new second rubber 103. The user simply aligns locking pin 107 of second rubber 103 with locking pin guide 196 of stripper pot plate 192. The user rotates the second rubber 103 to direct the locking pin to locking pin aperture 198 such that locking pin 107 engages locking pin aperture 198 to fixedly attach the second rubber 103 to stripper pot plate 192.

The attachment of second rubber 103 to stripper pot plate 192 also prevents unnecessary damage to the rotating head assembly caused by unsecured stripper pot plate fastener 206. The present invention partially encloses stripper pot plate fastener 206 to prevent accidental removal of stripper pot plate fastener 206. Second rubber 103 prevents an unsecured stripper pot plate fastener 206 from damaging and interfering with the normal operation of a drilling rig. Stripper pot plate fastener 206 secures into bottom pot 102. Second rubber 103 abuts bottom pot 102 to seal stripper pot plate fastener 206 between second rubber 103 and bottom pot 102.

The dual rubber cartridge seals fasteners to prevent accidental removal of the fasteners and the resulting damage of unsecured fasteners. The dual rubber cartridge of the present invention, in addition, provides a convenient attachment of a first and second rubber to increase operation of the drilling rig.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A housing apparatus configured to attach a first stripper rubber and a second stripper rubber to an inner barrel of a rotating head assembly to seal against a drilling string that passes along a vertical axis through the housing, the first stripper rubber, and the second stripper rubber; the housing apparatus comprising:

a housing configured to receive the first stripper rubber and the second stripper rubber for attachment of the first stripper rubber and the second stripper rubber to the housing, the housing configured to attach to a surface of the inner barrel;

the first stripper rubber attaches to said housing;

the second stripper rubber attaches to said housing vertically below the first stripper rubber, wherein the second stripper rubber attaches to the housing radially outward from the attachment of the first stripper rubber to the housing; and a stripper adapter fixedly attaches to the inner barrel, said stripper adapter configured to receive the housing for attachment of the housing to the inner barrel.

2. The apparatus of claim 1 further comprising:

a locking pin configured to attach the housing to the stripper adapter; and at least one locking pin aperture configured to receive the locking pin to attach the housing to the stripper adapter.

3. The apparatus of claim 1 further comprising:

a stripper base fastener configured to attach said first stripper rubber to said housing wherein said stripper adapter contacts said stripper base fastener to prevent removal of said stripper base fastener.

4. A housing apparatus configured to attach a first stripper rubber and a second stripper rubber to an inner barrel of a rotating head assembly to seal against a drilling string that passes along a vertical axis through the housing, the first stripper rubber, and the second stripper rubber; the housing apparatus comprising:

a housing configured to receive the first stripper rubber and the second stripper rubber for attachment of the first stripper rubber and the second stripper rubber to the housing, the housing configured to attach to a surface of the inner barrel;

the first stripper rubber attaches to said housing;

the second stripper rubber attaches to said housing vertically below the first stripper rubber, wherein the second stripper rubber attaches to the housing radially outward from the attachment of the first stripper rubber to the housing; and a stripper attachment lip within the housing, the stripper attachment lip extending internally into the housing, the stripper attachment lip configured to receive said first stripper rubber for attachment of the first stripper rubber to the housing.

5. A housing apparatus configured to attach a first stripper rubber and a second stripper rubber to an inner barrel of a rotating head assembly to seal against a drilling string that passes along a vertical axis through the housing, the first stripper rubber, and the second stripper rubber; the housing apparatus comprising:

a housing configured to receive the first stripper rubber and the second stripper rubber for attachment of the first stripper rubber and the second stripper rubber to the housing, the housing configured to attach to a surface of the inner barrel;

the first stripper rubber attaches to said housing;

the second stripper rubber attaches to said housing vertically below the first stripper rubber, wherein the second stripper rubber attaches to the housing radially outward from the attachment of the first stripper rubber to the housing; and a stripper pot plate that attaches to the housing, said stripper pot plate configured to receive said second stripper rubber for attaching the second stripper rubber to the housing.

6. The apparatus of claim 5 further comprising:

a locking pin configured to attach the second stripper rubber to the stripper pot plate; and at least one locking pin aperture configured to receive the locking pin wherein said locking pin aperture receives the locking pin to attach the second stripper rubber to the stripper pot plate.

7. The apparatus of claim 5 further comprising:

a stripper pot plate fastener configured to attach said stripper pot plate to said housing wherein said second stripper rubber contacts said stripper pot plate fastener to prevent removal of said stripper pot plate fastener.

8. A housing apparatus configured to attach a first stripper rubber and a second stripper rubber to an inner barrel of a rotating head assembly to seal against a drilling string that passes along a vertical axis through the housing, the first stripper rubber, and the second stripper rubber; the housing apparatus comprising:

a housing configured to attach the first stripper rubber and the second stripper rubber to the inner barrel wherein the housing rotates with the inner barrel to rotate the first stripper rubber and the second stripper rubber, the housing configured to attach to a surface of the inner barrel;

the first stripper rubber attaches to the housing wherein at least a portion of the first stripper rubber is within the housing, the first stripper rubber attaching vertically above the second stripper rubber;

an attachment lip extending radially inward from the housing, the first stripper rubber attaching to the attachment lip vertically above the attachment lip and at least a portion of the first stripper rubber extends vertically downward below the attachment lip; and the second stripper rubber attaches to the housing wherein at least a portion of the second stripper rubber extends vertically below the housing.

9. The apparatus of claim 8 further comprising:

a stripper adapter that attaches to the inner barrel, the stripper adapter configured to receive the housing for attachment of the housing to the inner barrel;

at least one locking pin configured to attach the housing to the stripper adapter;

at least one locking pin aperture configured to receive the locking pin to attach the housing to the stripper adapter.

10. The apparatus of claim 9 further comprising:

at least one locking pin guide configured to direct the locking pin to the locking pin aperture.

11. The apparatus of claim 8 further comprising:

a stripper attachment lip within the housing, the stripper attachment lip extending internally into the housing, the stripper attachment lip configured to receive said first stripper rubber for attachment of the first stripper rubber.

12. The apparatus of claim 8 further comprising:

a stripper pot plate configured to attach to the housing, said stripper pot plate configured to receive the second stripper rubber for attachment of the second stripper rubber to the housing.

13. The apparatus of claim 12 further comprising:

at least one locking pin configured to attach the second stripper rubber to the stripper pot plate; and at least one locking pin aperture configured to receive the locking pin to attach the second stripper rubber to the stripper pot plate.

14. The apparatus of claim 9 further comprising:

a stripper base fastener configured to attach said first stripper rubber to said housing wherein said stripper adapter contacts said stripper base fastener to prevent removal of said stripper base fastener.

15. The apparatus of claim 8 further comprising:

a stripper pot plate fastener configured to attach said stripper pot plate to said housing wherein said second stripper rubber contacts said stripper pot plate fastener to prevent removal of said stripper pot plate fastener.

16. A method of installing a first stripper rubber and a second stripper rubber to an inner barrel of a rotating head assembly to rotate the stripper rubbers with the inner barrel, the inner barrel having an upper portion and a lower portion, the method comprising:

attaching the first stripper rubber to a housing wherein at least a portion of the first stripper rubber is within the housing;

attaching the second stripper rubber to the housing wherein said second stripper rubber extends at least partially outside of the housing, attaching the second stripper rubber to the housing radially outward from the attachment of the first stripper rubber to the housing; and securing the housing to the lower portion of the inner barrel.

17. The method of claim 16 wherein the step of attaching the second stripper rubber to the housing further comprises:

directing a locking pin to a locking pin aperture to attach the second stripper rubber to the housing.

18. The method of claim 16 wherein the step of securing the housing to the inner barrel further comprises:

directing a locking pin to a locking pin aperture to secure the housing to the inner barrel.

* * * * *